United States Patent [19]

Lodini

[11] Patent Number: 4,876,419

[45] Date of Patent: Oct. 24, 1989

[54] TWO-DIMENSIONAL ELECTRIC CONDUCTOR DESIGNED TO FUNCTION AS AN ELECTRIC SWITCH

[75] Inventor: Paolo Lodini, Turin, Italy

[73] Assignee: Leda Logarithmic Electrical Devices for Automation S.r.l., Turin, Italy

[21] Appl. No.: 201,598

[22] Filed: Jun. 2, 1988

Related U.S. Application Data

[63] Continuation-in-part of Ser. No. 145,612, Jan. 19, 1988.

[30] Foreign Application Priority Data

Jun. 2, 1987 [IT] Italy ..... 67473 A/87

[51] Int. Cl.[4] ..... H01H 3/14

[52] U.S. Cl. ..... 200/86 R; 338/114; 340/667

[58] Field of Search ..... 340/665, 666, 667; 200/85 R, 85 A, 86 R, 86 A, 61.41, 61.43; 307/119; 338/114, 99, 100, 112

[56] References Cited

U.S. PATENT DOCUMENTS

| | | | |
|---|---|---|---|
| 3,830,991 | 9/1974 | Durocher | 200/86 R |
| 4,172,216 | 10/1979 | O'Shea | 338/114 |
| 4,258,100 | 3/1981 | Fujitani | 338/114 |
| 4,295,699 | 10/1981 | Durocher | 338/99 |
| 4,317,970 | 3/1982 | Hafner | 200/86 R |
| 4,529,959 | 7/1985 | Ito | 338/114 |
| 4,570,149 | 2/1986 | Thornburg | 338/114 |
| 4,757,297 | 7/1988 | Frawley | 338/214 |

FOREIGN PATENT DOCUMENTS

| | | |
|---|---|---|
| 0212454 | 3/1987 | European Pat. Off. . |
| 1942565 | 3/1971 | Fed. Rep. of Germany . |
| 3006678A1 | 8/1981 | Fed. Rep. of Germany . |
| 2246959 | 5/1975 | France . |
| 497777 | 11/1970 | Switzerland . |
| 2045527A | 10/1980 | United Kingdom . |

*Primary Examiner*—Gerald P. Tolin
*Attorney, Agent, or Firm*—Klauber & Jackson

[57] ABSTRACT

A conductor comprising a first and second electric conducting element, each in the form of a flat plate, and at least a third electric conducting element also in the form of a flat plate. The first and second conducting elements are arranged with one surface contacting a surface on the third conducting element; and a spacer element formed from insulating material is placed between the mating surfaces of two of the aforementioned conducting elements, so as to at least partially shield the aforementioned surfaces. The structure of the material from which the third electric conducting element is formed comprises a supporting matrix formed from flexible, electrically-insulating material and particles of electrically-conductive material scattered in random, substantially uniform manner inside cells on the aforementioned matrix; which cells communicate at least partially with one another, and are at least partially larger in size than the respective particles of electrically-conductive material housed inside the same.

7 Claims, 8 Drawing Sheets

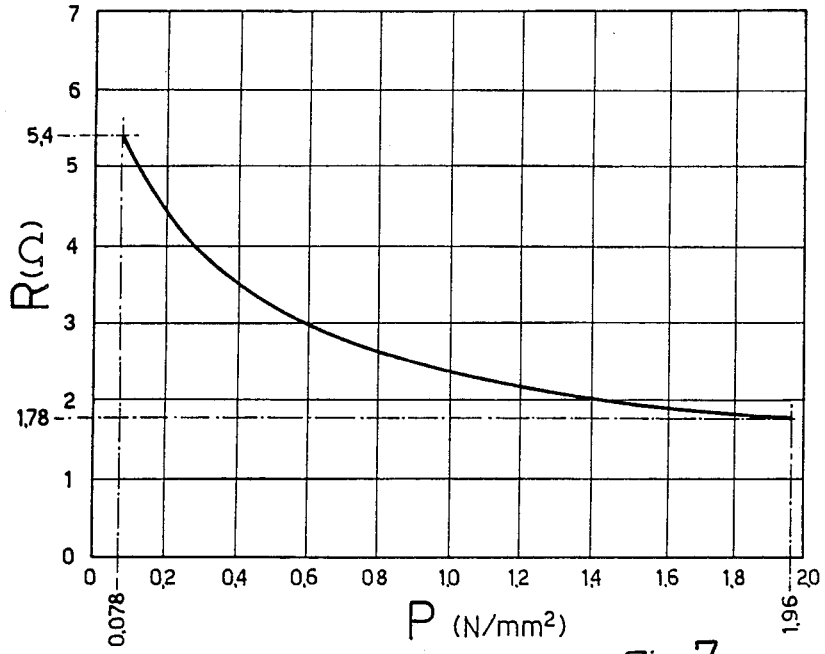
Fig.7
Fig.8
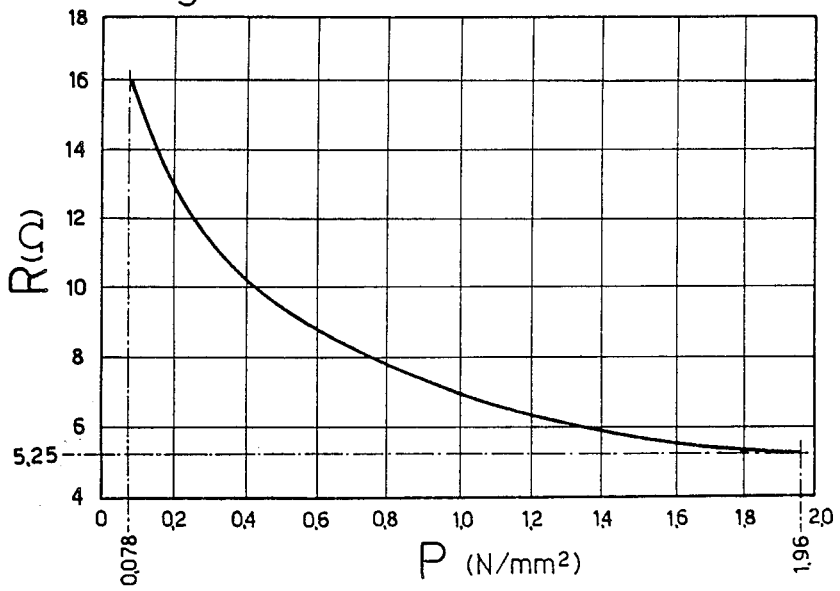

TWO-DIMENSIONAL ELECTRIC CONDUCTOR DESIGNED TO FUNCTION AS AN ELECTRIC SWITCH

REFERENCE TO RELATED APPLICATION

This application is a continuation-in-part of U.S. patent application Ser. No. 07/145,612, filed Jan. 19, 1988, to the same applicant and entitled Process for Producing Electric Resistors having a Wide Range of Specific Resistance Values.

BACKGROUND OF THE INVENTION

The present invention relates to a two-dimensional electric conductor designed to function as an electric switch and enabling the formation of an electric circuit comprising any number of electric switches located at any point on a flat surface.

The two-dimensional electric conductor according to the present invention is designed to solve the problem of closing an electric circuit by applying given pressure at any point on a flat surface. Such performance is frequently required in a number of technical applications, e.g. for producing an electric signal for activating a relay, for example, and so indicating that external pressure is being applied at any point on a surface.

At present, this problem can only be solved approximately, by setting out a number of separate switches having their terminals connected to conductors on an electric line. Such a system, however, only enables control of a limited number of points on the surface. What is more, the said electric line is unreliable and involves the use of numerous switches and electric conductors, connection of which is both time-consuming and expensive.

SUMMARY OF THE INVENTION

The aim of the present invention is to provide a two-dimensional electric conductor designed to function as an electric switch, and to solve the aforementioned problem without involving any of the aforementioned drawbacks. With this aim in view, according to the present invention, there is provided a two-dimensional electric conductor, characterised by the fact that it comprises a first and second electric conducting element, each in the form of a flat plate; and at least a third electric conducting element, also in the form of a flat plate; the said first and second electric conducting elements being arranged in such a manner that one surface contacts a surface on the said third electric conducting element; and a spacer element formed from electrically-insulating material being arranged between the opposite surfaces of the said third element and at least one of the said first and second elements, so as to at least partially shield the said two surfaces; the structure of the material from which the said third electric conducting element is formed comprising a supporting matrix formed from flexible, electrically-insulating material and particles of electrically-conductive material scattered in random, substantially uniform manner inside cells on the said matrix; said cells communicating at least partially with one another, and being at least partially larger in size than the respective particles of electrically-conductive material housed inside the same.

The structure of the said material from which the said third electric conducting element is formed is as described in U.S. patent application Ser. No. 07/145,612, filed Jan. 19, 1988, by the present Applicant and entitled: "Electric resistor designed for use as an electric conducting element in an electric circuit, and relative manufacturing process", to which the reader is referred for further details. The entire disclosure of U.S. patent application Ser. No. 07/145,612 is incorporated herein by reference.

BRIEF DESCRIPTION OF THE DRAWINGS

The present invention will be described, by way of a nonlimiting example, with reference to the accompanying drawings, in which.

Figure 11:
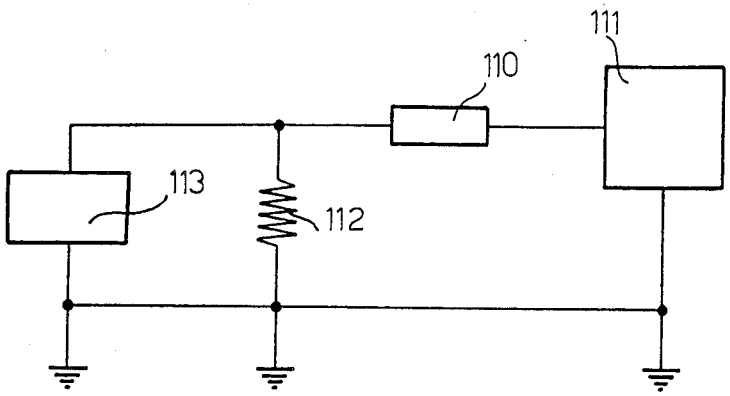
Figure 10:
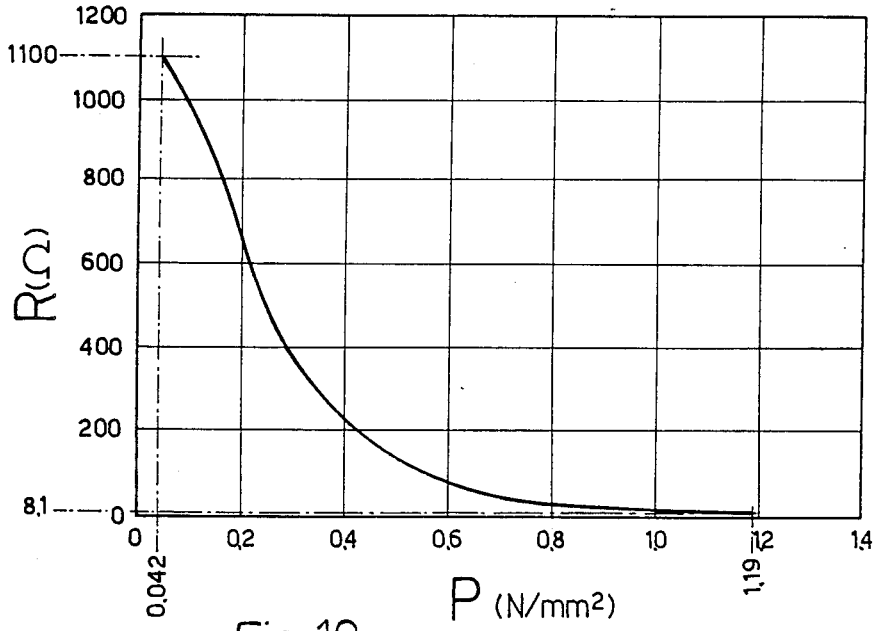

The graphs in FIGS. 7 to 10 show the variation in electrical resistance of the resistor according to the present invention, as a function of the pressure exerted on the resistor itself;

FIG. 11 shows a schematic diagram of a test circuit arrangement for plotting the results shown in FIGS. 7 to 10; and FIGS. 12 to 16 show schematic diagrams of the basic stages in the process for producing the electric resistor according to the present invention.

DETAILED DESCRIPTION OF THE INVENTION

Figure 1:
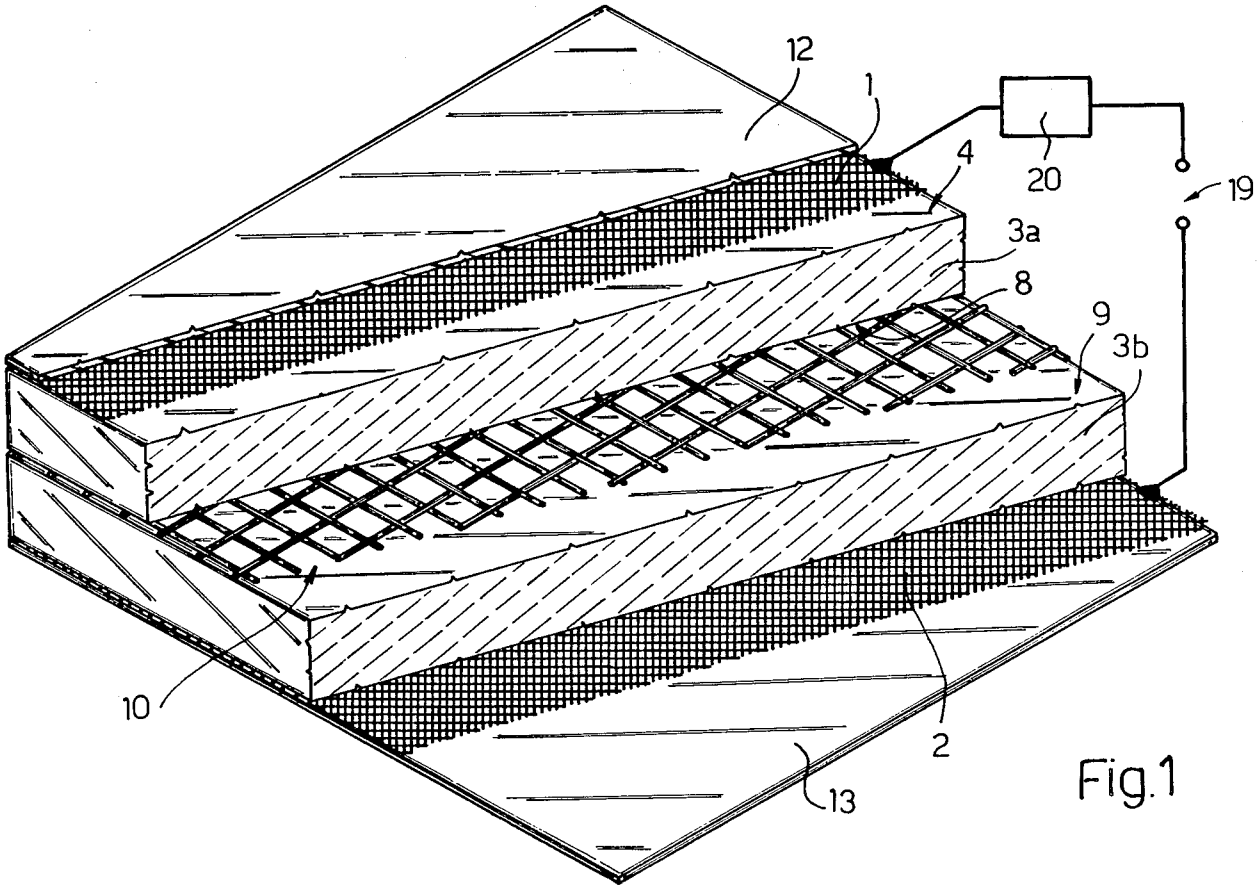
FIG. 1 shows a cross section of a first embodiment of a two-dimensonal electric conductor in accordance with the teachings of the present invention.

With reference to FIG. 1, the two-dimensional electric conductor according to the present invention is substantially in the form of a flat plate, and comprises a first and second electric conducting element 1 and 2, and at least a third electric conducting element 3, each in the form of a flat plate. In the FIG. 1 embodiment, provision is made for a pair of third conducting elements 3*a* and 3*b*. The said conducting elements are arranged one on top of the other, so as to form a structure in which upper surface 4 of element 3*a* contacts lower surface 5 of element 1, and lower surface 6 of element 3*b* contacts surface 7 of element 2. Between surfaces 8 and 9 of elements 3*a* and 3*b*, there is provided a spacer element 10 formed from electrically-insulating material; and on the outer surfaces of elements 1 and 2, there are provided layers of insulating material 12 and 13.

Figure 2:
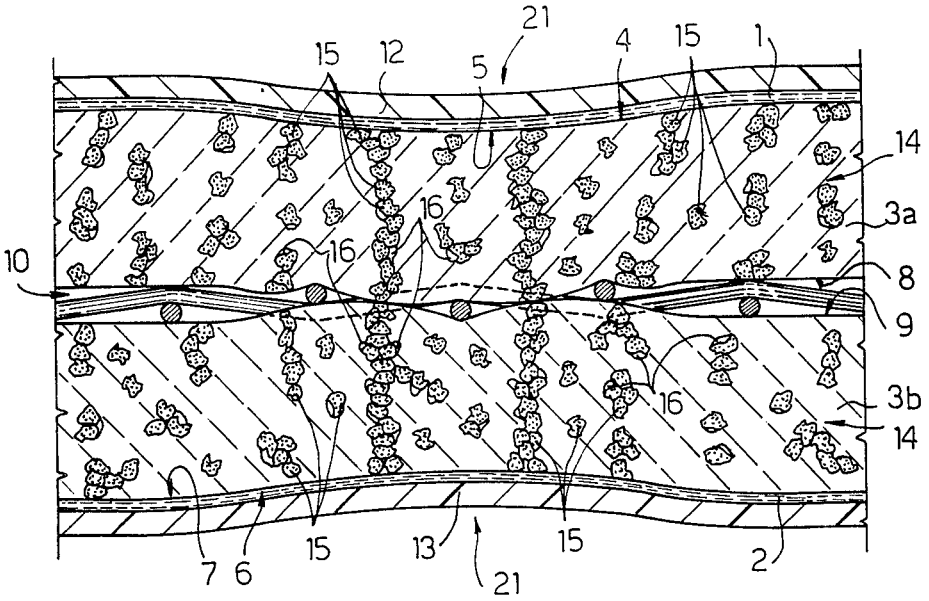
FIG. 2 shows a larger-scale detail of the FIG. 1 section.

The material of the said third conducting element (3*a* and 3*b* in the FIG. 1 embodiment) presents a structure comprising a supporting matrix 14 (FIG. 2) formed from flexible, electrically-insulating material, and particles 15 of electrically-conductive material scattered in random, substantially uniform manner inside cells in the said matrix. The said cells communicate, at least partially, with one another, and are, at least partially, larger than the respective particles of electrically-conductive material housed inside the same, so as to define gaps 16 between the surfaces of particles 15 and the said cells.

A material presenting the aforementioned structure is described in U.S. patent application Ser. No. 07/145,612, filed Jan. 19, 1988, by the present Applicant and entitled: "Electric resistor designed for use as an electric conducting element in an electric circuit, and relative manufacturing process."

As stated in the aforementioned Patent Application, the said material is electrically conductive, and presents the favourable property of increasing in electrical conductivity as increasing pressure is applied on it. Such favourable performance is due to improved electrical conductivity of chains of particles 15. In fact, as increasing pressure is applied on the material, this improves the conductivity of chains of contacting particles 15, while at the same time rendering conductive any chains of non-contacting particles 15, when sufficient pressure is applied for reducing or eliminating gaps 6 between the said non-contacting particles 15. Conducting elements 1 and 2 may be formed from wire mesh.

To enable a clearer understanding of the process according to which the third conducting elements 3*a* and 3*b* are formed, a description will first be given of the structure of the resistor so formed.

Figure 5:
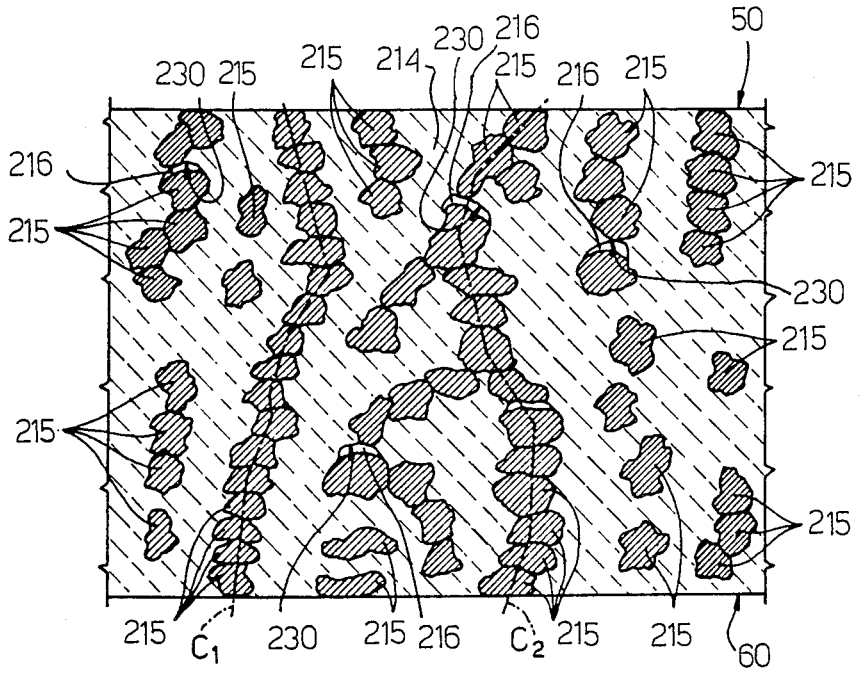
FIGS. 5 and 6 show two structural sections, to different scales, of a portion of the resistor according to the present invention.
Figure 6:
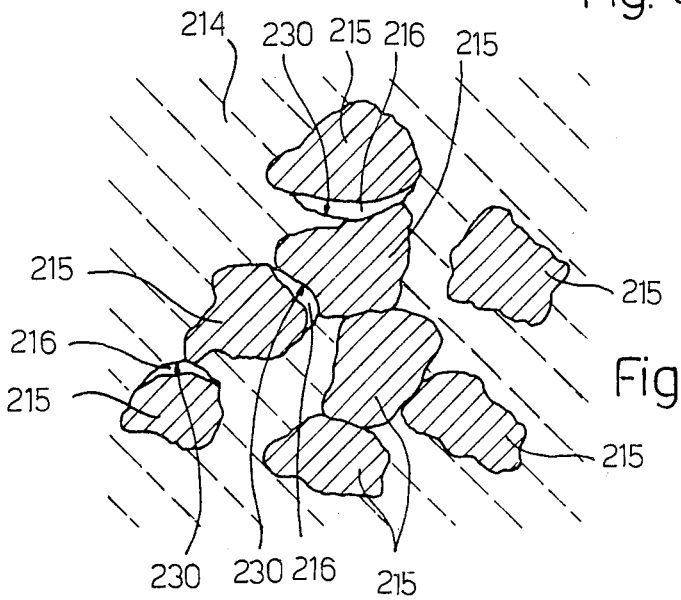
Figure 9:
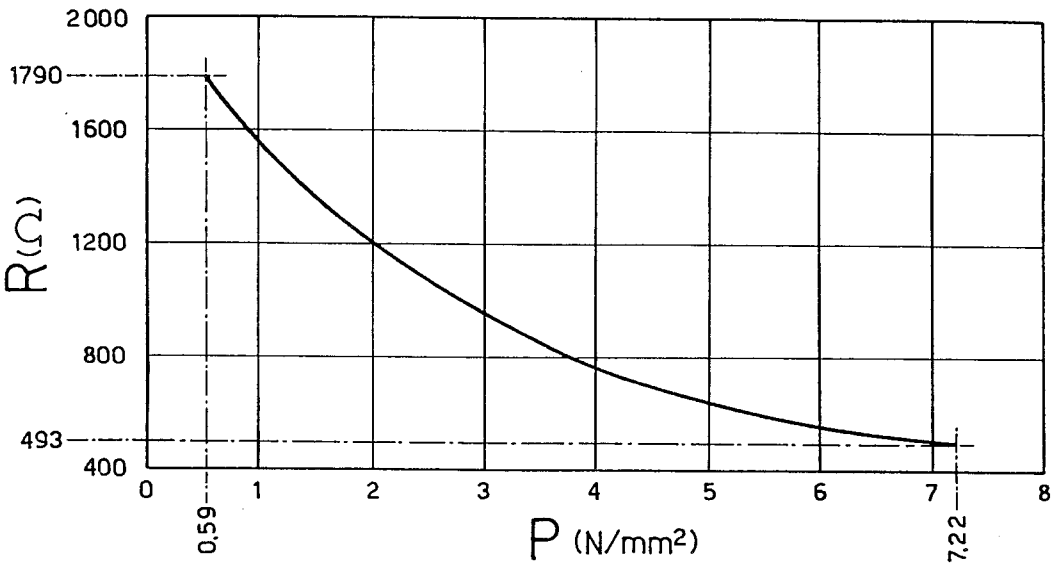

The structure of the resistor is as shown in FIGS. 5 and 6, which show sections of a portion of the resistor enlarged a few hundred times.

The said resistor substantially comprises a supporting matrix 214, formed from flexible, electrically insulating material, and particles 215 of electrically conductive material arranged in substantially uniform manner inside corresponding cells 230 on the said matrix 214. As in the embodiment shown, the said particles preferably consist of granules of electrically conductive material. As shown in the larger-scale section in FIG. 6, at least some (e.g. 50 to 90%) of the said cells communicate with one another, and in a number of cases, are exactly the same shape and size as the granules contained inside. Other cells, on the other hand, are slightly larger than the said granules, so as to form a minute gap 216 between at least part of the outer surface of the granule and the corresponding inner surface portion of the respective cell.

The arrangement of cells 230, and therefore also of granules 215, inside matrix 214 is entirely random. Though the advantages of the resistor according to the present invention are obtainable even if only a few of cells 230 communicate with one another, it is nevertheless preferable for most of them to do so. For best results, the estimated percentage of communicating cells is around 50–90%.

Though conducting granules 215 may be of any size, this conveniently ranges between 10 and 250 microns. Likewise, granules 15 may be of any shape and, in this case, are preferably irregular, as shown in FIGS. 5 and 6.

Matrix 214 may be formed from any type of electrically insulating material, providing it is flexible enough to flex, when a given pressure is applied on the resistor, and return to its original shape when such pressure is released. Furthermore, the material used for the matrix must be capable of assuming a first state, in which it is sufficiently liquid for it to be injected into a granule structure statistically presenting each of the said granules arranged at least partially contacting the adjacent granules with which it defines a number of gaps; and a second state in which it is both solid and flexible. The viscosity of the liquid material conveniently ranges from 500 to 10,000 centipoise.

Matrix 214 may conveniently be formed from synthetic resin, preferably a synthetic thermoplastic resin, which presents all the aforementioned characteristics and is thus especially suitable for injection into a granule structure of the aforementioned type.

Though the size of granules 215, which depends on the size of the resistor being produced, is not a critical factor, the said granules are preferably very small, ranging in size from 10 to 250 microns.

The conducting material used for the granules may be any type of metal, e.g. iron, copper, or any type of metal alloy, or non-metal material, such as graphite or carbon. The materials for matrix 214 and granules 215 may thus be selected from a wide range of categories, providing they present the characteristics already mentioned.

The material employed for matrix 214 which, as already stated, must be flexible and insulating, is preferably, though not necessarily, so precompressed inside matrix 214 itself as to exert sufficient pressure on particles 215 to maintain contact between the same. It follows, therefore, that each minute element of the said matrix 214 material is in a sufficiently marked state of triaxial precompression as to exert on adjacent elements, in particular particles 215, far greater stress, for producing contact pressure between the surfaces of the said particles, than if the said triaxial precompression were not provided for. As will be made clearer later on, such a state of triaxial precompression is a direct consequence of the process according to the present invention.

With the structure described and shown in FIGS. 5 and 6, the resistor according to the present invention presents an extremely large number of granules 215 of conducting material, which granules either contact one another, or are separated from adjacent granules by extremely small gaps 216 which may be readily bridged when given pressure is applied on the resistor. This results in the formation, inside the said structure, of a number of electrical conductors, each consisting of a chain comprising an extremely large number of granules 215, which are normally already arranged contacting one another inside the said structure. Each of the said chains may electrically connect end surfaces 50 and 60 on the resistor directly, as shown by dotted line C1 in FIG. 5. Alternatively, chains may be formed inside the resistor, as shown by dotted line C2 in FIG. 5, in which the individual granules in the chain are partly arranged contacting one another directly, and partly separated solely by gaps 216. The granules in such chains may be brought into contact, as in the case of chain C1, by subjecting surfaces 50 and 60 on the resistor to a given pressure sufficient to flex the material of matrix 214 so bridge the said gaps for bringing the adjacent granules separated by the same into direct contact.

The process according to the present invention is as follows.

The first step is to prepare a homogeneous system comprising particles, preferably granules, of a first electrically conductive material arranged in substantially uniform manner inside a mass of a second liquid material which, when solidified, is both electrically insulating and flexible. The mass of the said second liquid material is then solidified to form a supporting matrix for the granules. According to the present invention, throughout solidification of the said second material, a given pressure is applied on the system for the purpose of producing triaxial precompression of the said second material when solidified. Such pressure, which is maintained substantially constant throughout solidification, ranges from a few tenths of a $N/mm^2$ to a few $N/mm^2$.

For forming the said homogeneous system, a granule structure is first formed, which structure statistically presents each granule arranged at least partially contacting the adjacent granules, with which it defines a number of gaps which are then injected with the said second liquid material. The said second material may be liquified by simply heating it to a given temperature. For solidifying it, cooling is usually sufficient. In the case of synthetic resins, however, these must be solidified by means of curing.

The process according to the present invention may comprise the following stages.

Figure 12:
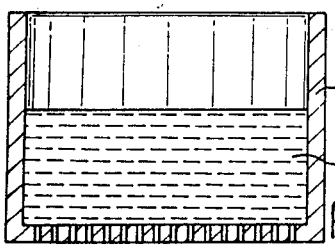

A first stage, in which a mass of electrically conductive granules 116 is formed, for example, inside an appropriate vessel 115 (FIG. 12). For this purpose, the granules, after being poured into the said vessel, are vibrated so as to enable settling. The bottom of vessel 115 is conveniently either porous or provided with holes for letting out the air or gas trapped between the granules.

Figure 13:
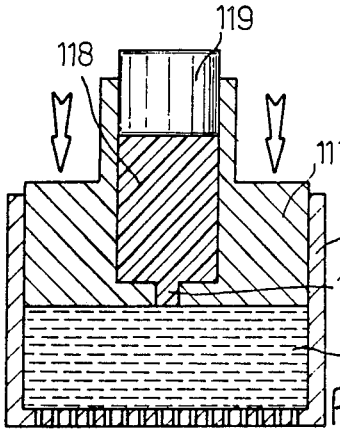

A second stage, as shown in FIG. 13, in which the mass of granules 116 is compacted by subjecting it to a given pressure, e.g. by means of piston 117, applied in any appropriate manner on the upper surface of mass 116. This produces a granule structure in which, statistically, at least part of the surface of each granule is arranged contacting surface portions of the adjacent granules, with gaps inbetween.

Figure 14:
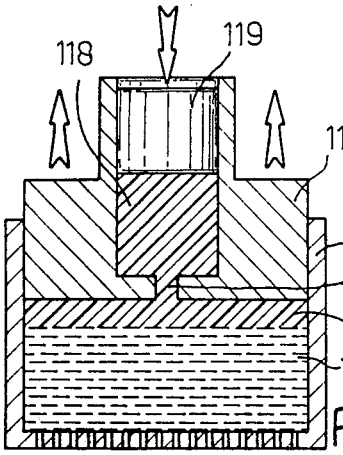
Figure 15:
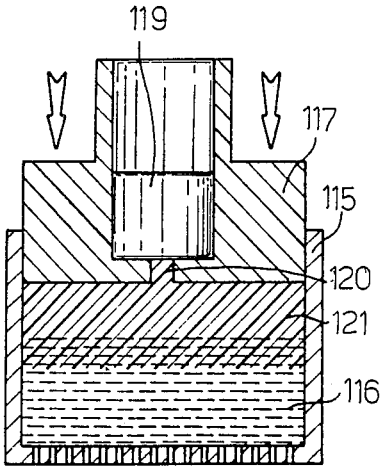

As shown in FIG. 13, piston 117 is conveniently provided with a tank 118 containing the said second material in liquid form; which liquid material may be forced, e.g. by a second piston 119, through hole 120 into a chamber 121 defined between the upper surface of granules 116 and the lower surface of piston 117 as shown clearly in FIG. 14. The said second liquid material in tank 118 is a material which may be solidified and, when it is, is both insulating and flexible. In the event the said material is liquified by heating, appropriate heating means (not shown) are also provided for.

A third stage (FIGS. 14 and 15) in which piston 119 moves down and piston 117 up, so as to force a given amount of the said second liquid material inside chamber 121 (FIG. 14). Piston 117 is then brought down for producing a given pressure inside the liquid material in chamber 121 and so forcing it to flow into the gaps between the granules in mass 116 and form, with the said granules, the said homogeneous system. At the same time, any air between the granules is expelled through the porous bottom of vessel 115. The pressure produced by piston 117, at this stage, inside the liquid material mainly depends on the size of the granules, the viscosity of the liquid, the height of the granule mass being impregnated, and required impregnating time.

Penetration of the liquid material inside the gaps in granule mass 116 has been found to have no noticeable effect on the granule arrangement produced in the compacting stage.

A fourth stage (FIG. 15) in which the homogeneous system of granules and liquid material produced in the foregoing stage is substantially solidified. This may be achieved by simply allowing the system to cool and the said second liquid material to set. At this stage, changes may be observed in the structure of the said second material due, for example, to curing of the same.

Figure 16:
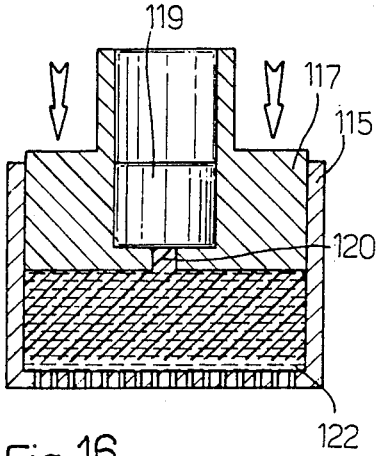

It has been found necessary to dose the liquid material fed into chamber 121 prior to the injection stage, in such a manner as to ensure that it is sufficient to impregnate only a large part of granule mass 116 leaving a nonimpregnated layer 122 (e.g. of about 25%). In like manner, the liquid material flowing inside the gaps between the granules is subjected solely to atmospheric pressure through the porous bottom of vessel 115. The granules, on the other hand, (be they impregnated or not), are subjected to the pressure exerted by piston 117, as shown in FIG. 16. The said pressure is applied evenly over all the contact points between adjacent granules, and is what determines the specific electrical resistance of the resulting material. That is to say, using the same type of granules and liquid material, an increase in the said pressure results, within certain limits, in a reduction of the specific electrical resistance of the resulting material. The said pressure must be maintained constant until the liquid material has set, and must be at least equal or greater than the compacting pressure applied in stage 2 (FIG. 13).

Though the said pressure may be selected from within a very wide range, convenient pressure values have been found to range from a few tenths of a $N/mm^2$ to a few $N/mm^2$. For resistors prepared as described in the following examples, the following pressures were selected:

Example 1 : 1.17 $N/mm^2$
Example 2 : 0.62 $N/mm^2$
Example 3 : 1.56 $N/mm^2$
Example 4 : 2.35 $N/mm^2$
Example 5 : 1.17 $N/mm^2$ The mass of material so formed inside vessel 115 may be cut, using standard mechanical methods, into any shape or size for producing the electric resistor according to the present invention.

To those skilled in the art it will be clear that changes may be made to both the resistor and the process as described and illustrated herein without, however, departing from the scope of the present invention.

In particular, granules 215 arranged inside matrix 214 may be replaced by particles of electrically conductive material of any shape or size, e.g. short fibres.

For preparing the said homogeneous system comprising particles of a first electrically conductive material distributed inside a mass of a second liquid material which, when solidified, is both electrically insulating and flexible, processing stages may be adopted other than those described with reference to FIGS. 12 to 16.

The said homogeneous system, in fact, may be obtained by mixing the said particles mechanically with the said second liquid material, using any appropriate means for the purpose.

According to the aforementioned variation, throughout solidification of the said second material, the said system is forced against a porous (or punched) septum for letting out, through the said septum, at least part of the said second liquid material. The pressure so produced may be maintained until the said second material solidifies, so as to produce the said triaxial precompression in the solidified said second material.

For achieving the said precompression, the said system may be spun throughout solidification of the said second liquid material.

When incorporated in an electric circuit, performance of the resistor according to the present invention is as follows.

If no external pressure is applied on the resistor, and end surfaces 50 and 60 are connected electrically via appropriate conductors, electric current may be fed through the resistor as in any type of rheophore. The density of the current feedable through the resistor has been found to be very high, at times in the region of ten A/cm$^2$. When idle, the resistance of the resistor according to the present invention may, therefore, be low enough to produce an electrical conductor capable of handling a high current density, as required for supplying a circuit component or device. A number of resistance values relative to resistors produced by appropriately selecting the characteristics of the particles and the material of matrix 214, and the parameters of the present process, are shown in the Examples given later on.

Total resistance of the resistor so formed has been found to be constant, and dependent solely on the structure of the resistor, in particular, the number and size of communicating cells 230 in matrix 214, and the number of gaps 216 separating adjacent granules 215.

By appropriately selecting the aforementioned parameters, some of which depend on the process described, a resistor may be produced having a given prearranged resistance. When pressure is applied perpendicularly to surfaces 50 and 60, the electrical resistance measured perpendicularly to the said surfaces is reduced in direct proportion to the amount of pressure applied. FIGS. 7 to 10 show four resistance-pressure graphs by way of examples and relative to four different types of resistors, the characteristics of which will be discussed later on. As shown in the said graphs, the fall in resistance as a function of pressure is a gradual process represented by a curve usually presenting a steep initial portion. Even very light pressure, such as might be applied manually, has been found to produce a considerable fall in resistance. In the case of a resistor having the resistance-pressure characteristics shown in FIG. 10, starting resistance was reduced to less than one percent by simply applying a pressure of around 1 N/mm$^2$ (about 10 kg/cm$^2$). With a different structure and pressures of around 2 N/mm$^2$ (about 20 kg/cm$^2$), starting resistance may be reduced by $\frac{1}{3}$ (as shown in the FIG. 7 graph).

If the pressure applied on the resistor according to the present invention is maintained constant (or zero pressure is applied), electrical performance of the resistor has been found to conform with both Ohm's and Joule's law. For application purposes, it is especially important to prevent the heat generated inside the resistor (Joule effect) from damaging the structure. This obviously entails knowing a good deal about the thermal performance of the material from which the supporting matrix is formed.

Assuming the resistor according to the present invention is capable of withstanding an average maximum temperature of 50° C., under normal heat exchange conditions with an ambient air temperature of 20° C., the density of the current feedable through the resistor ranges from 0.2 A/cm$^2$ (Example 4) to 11 A/cm$^2$ (Example 5) providing no external pressure is applied.

In the presence of external pressure, such favourable performance of the electric resistor according to the present invention is probably due to improved electrical conductivity of granule chains such as C1 and C2 in FIG. 5. In fact, as pressure increases, the conductivity of contacting-granule chains (such as C1) increases due to improved electrical contact between adjacent granules, both on account of the pressure with which one granule is thrust against another, and the increased contact area between adjacent granules. In addition to this, granule chains such as C2, in which the adjacent granules are separated by gaps 216, also become conductive when a given external pressure is applied for bridging the gaps between adjacent pairs of otherwise non-conductive granules.

Total electrical conductivity of the granule chains increases gradually alongside increasing pressure by virtue of matrix 14 being formed from flexible material, and by virtue of the said material being precompressed triaxially. As a result, adjacent granules separated by gaps 216 are gradually brought together, and the contact area of the granules already contacting one another is increased gradually as flexing of the matrix material increases. Each specific external pressure is obviously related to a given resistor structure and a given total conducting capacity of the same. When external pressure is released, the resistor returns to its initial unflexed configuration and, therefore, also its initial resistance rating.

In the said initial unflexed configuration, the electrical performance of the material the resistor is made of has been found to be isotropic, in the sense that the specific resistance of the material is in no way affected by the direction in which it is measured. If, on the other hand, the material the resistor according to the present invention is made of is flexed by applying external pressure in a given direction, the specific resistance of the material has been found to vary continuously in the said direction, depending on the amount and direction of the flexing pressure applied.

To illustrate the electrical performance of the resistor according to the present invention, when subjected to varying external pressure, four resistors featuring different structural parameters will now be examined by way of examples.

A fifth example will also be examined in which the specific resistance of the resistor according to the present invention is sufficiently low for it to be considered a conductor.

EXAMPLE 1

A cylindrical resistor, 12.6 mm in diameter and 7.4 mm high was prepared, as shown in FIGS. 12 to 16, using epoxy resin (VB-BO 15) for matrix 214.

Conducting granules 215 consisted of carbon powder ranging in size from 200 to 250 microns.

On resistors with granules of this sort, the matrix insulating material injected between the granules occupies approximately 56.8% of the total volume of the resistor. The resistor so formed was connected to the electric circuit in FIG. 11 in which it is indicated by number 110. The said circuit comprises a stabilized power unit 111 (with an output voltage, in this case, of 4.5 V), a load resistor 112 (in this case, 10 ohm), and a digital voltmeter 113, connected as shown in FIG. 11. Resistor 110 was subjected to pressures ranging from $7.8 \cdot 10^{-2}$ N/mm$^2$ to $196 \cdot 10^{-2}$ N/mm$^2$.

Resistance was measured by measuring the difference in potential at the terminals of resistor 112 using voltmeter 113, and plotted against pressure as shown in the FIG. 7 graph. From a starting figure of 5.4 Ohm, resistance gradually drops down to 1.78 Ohm as the said maximum pressure is reached.

EXAMPLE 2

A cylindrical resistor, 12.6 mm in diameter and 7.2 mm high was prepared as before using an alpha-cyanoacrylatebase resin for matrix 214 and carbon granules ranging in size from 200 to 250 microns.

Once again, the resistor was connected to the FIG. 11 circuit, the components of which presented the same parameters as in Example 1. The relative resistance-pressure graph is shown in FIG. 8, which shows a resistance drop from 16 to 5.25 Ohm between the same minimum and maximum pressures as in Example 1.

EXAMPLE 3

A tubular resistor with an outside diameter of 12.6 mm, an inside diameter of 3.5 mm, and 5.4 mm high was prepared as before, using epoxy resin (VB-BO 15) for the matrix and iron granules ranging in size from 50 to 150 microns. On resistors with granules of this sort, the matrix insulating material injected between the granules occupies approximately 55% of the total volume of the resistor. Resistance was again measured as shown in FIG. 11 using a 1000 Ohm load resistor 112 and 4.5 V power unit 111. Pressure was adjusted gradually from $59 \cdot 10^{-2}$ N/mm$^2$ to 7.22 N/mm$^2$ to give the graph shown in FIG. 9, which shows a resistance drop from 1790 to 493 Ohm between minimum and maximum pressure.

EXAMPLE 4

A 2.4 mm high tubular resistor having the same section as in Example 3 was prepared as before, using silicon resin for matrix 214 and iron granules ranging in size from 50 to 150 microns.

Resistance was again measured on the FIG. 11 circuit, using a 100 Ohm load resistor 112 and a 1.2 V power unit 111. Pressure was adjusted from $4.2 \cdot 10^{-2}$ N/mm$^2$ to $119 \cdot 10^{-2}$ N/mm$^2$ to give the graph shown in FIG. 10 which shows a resistance drop from 1100 to 8.1 Ohm between minimum and maximum pressure.

EXAMPLE 5

A 3.4 mm high tubular resistor having the same section as in Example 4 was prepared as before, using epoxy resin (VB-ST 29) for matrix 214 and tin granules ranging in size from 50 to 200 microns.

Resistance, measured in the absence of external pressure between the two bases of the tubular-section cylinder, was 0.08 Ohm. The specific resistance of the resistor material, in this case, therefore works out at 0.27 Ohm.cm, which is low enough for the resistor to be considered a conductor. Assuming heat (Joule effect) is dissipated by normal heat exchange in air at a temperature of 20° C., and the maximum temperature withstandable by the resistor is 50° C., the density of the current feedable through this resistor is approximately 11 A/cm$^2$.

Figure 3:
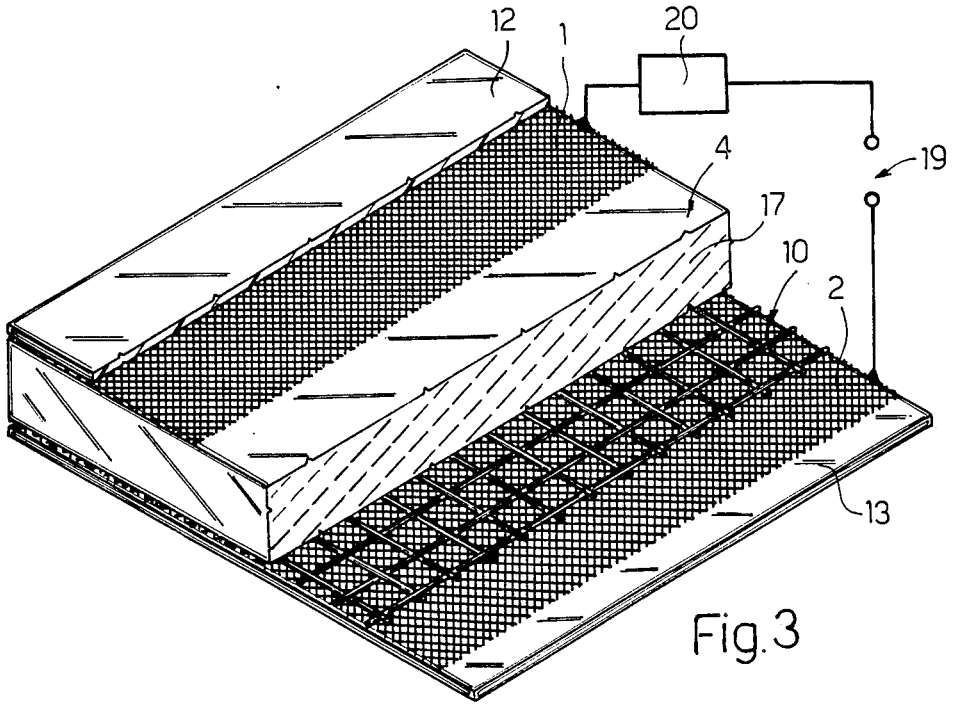
FIGS. 3 and 4 show cross sections of a second and third embodiment respectively of the two-dimensional electric conductor according to the present invention.

Instead of a pair of conducting elements 3*a* and 3*b* formed from the said material, the conductor in the FIG. 3 embodiment comprises only one such element 17. The FIG. 3 embodiment presents the same conducting elements as in the previous embodiment, which elements are indicated using the same numbering system, and spacer element 10 is located between elements 17 and 2 as shown clearly in FIG. 3.

Figure 4:
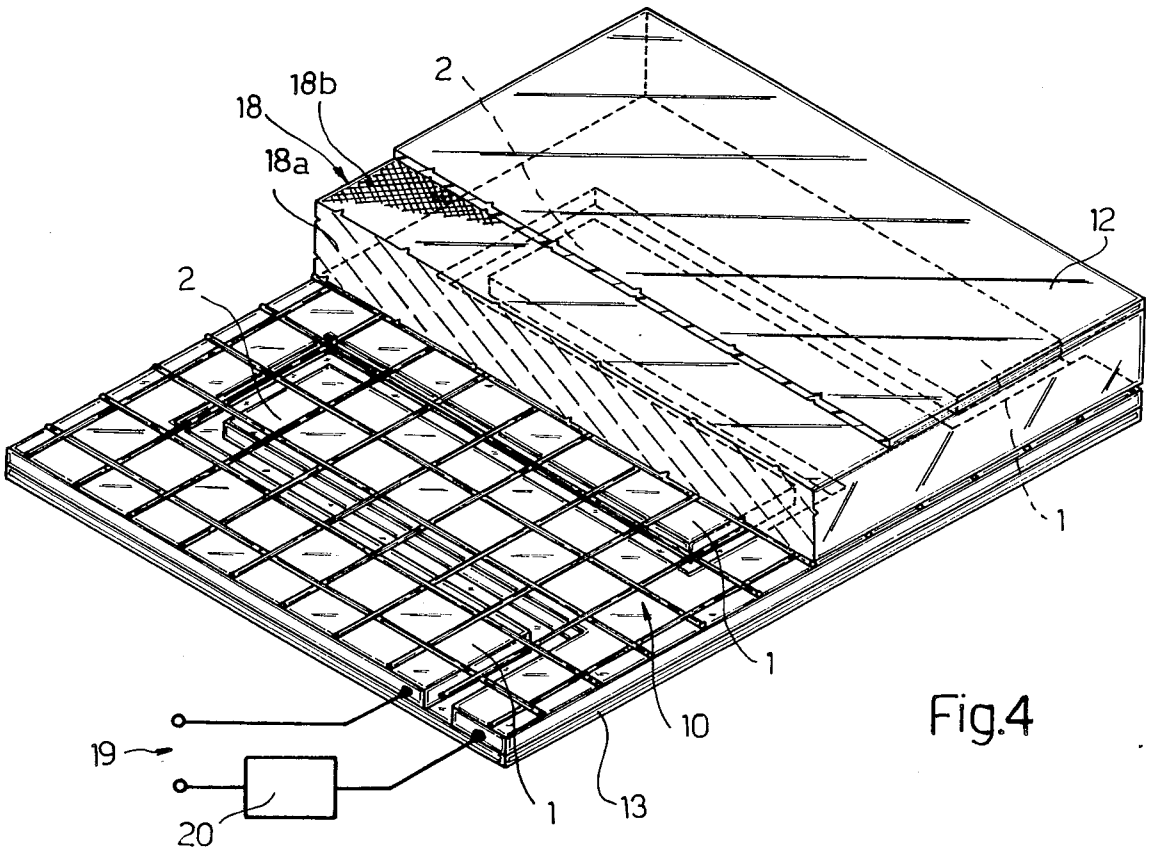

In the FIG. 4 embodiment, conducting elements 1 and 2 are formed in such a manner as to define a number of strips arranged alternately and substantially in the same plane, so as to present adjacent strips pertaining to different elements. Spacer element 10 is located between the said strips and the third conducting element which, in this case, is numbered 18 and consists of a flexible pad 18*a*, formed from the same conducting material as element 3 in the FIG. 1 embodiment, and a conducting mesh 18*b* having no external electrical connections. Spacer element 10 may, as in the previous case, be formed from a mesh of insulating material.

The two-dimensional electric conductor according to the present invention may be connected to an electric circuit comprising a current source, of which terminals 19 are shown in the attached drawings, and a user device, such as a relay 20.

The said circuit is formed so as to connect the said components to conducting elements 1 and 2, as shown in the attached drawings. When so arranged, and when no pressure is applied on the outer surfaces of the two-dimensional electric conductor according to the present invention, the said circuit is maintained open and current prevented from circulating inside the same by virtue of spacer element 10, which separates the surfaces of the conducting elements facing the respective surfaces of spacer element 10 itself.

When, on the other hand, pressure is applied on a given portion 21 (FIG. 2) of at least one of the outer surfaces of the conductor according to the present invention, this produces localised flexing of the said portion of the third conducting element (3*a*, 3*b*, 17 or 18), thus causing a surface of the said conducting element to contact the respective surface of the adjacent conducting element. Should both conducting elements 3*a* and 3*b* in the FIG. 1 embodiment be flexed, this results in contact between portions 21 of surfaces 8 and 9 (FIG. 2), thus closing the electric circuit and allowing current to circulate inside the same, for activating user device 20. As shown clearly in FIG. 2, closure of the circuit is made possible by surfaces 8 and 9 contacting on the portion left exposed by spacer element 10.

The same applies also to the conductors in the FIG. 3 and 4 embodiments, in the first of which, flexing of element 17 produces electrical contact between element 17 and the underlying conducting element 2, and, in the second, contact is established between two of the adjacent strips of conducting elements 1 and 2.

In addition to conducting current, the two-dimensional electric conductor according to the present invention clearly also provides for forming an infinite number of electric switches, each of which may be activated by pressure applied on any given point on the conductor itself. Furthermore, by virtue of the material of the said third conducting element increasing in conductivity alongside increasing pressure, the said pressure, in addition to closing the said circuit, also provides for producing a signal proportional to the amount of pressure applied.

To those skilled in the art it will be clear that changes may be made to the embodiments described and illustrated herein without, however, departing from the scope of the present invention.

I claim:

1. A two-dimensional electric conductor comprising a first and a second electric conducting element, each in the shape of at least a portion of a flat plate, at least one resilient electric conducting element in the shape of a flat plate and arranged in stacked relationship with said first and second conducting elements, and a spacer element formed from electrically-insulating material and also arranged in stacked relationship with said conducting elements, said spacer element being faced to a surface of said at least one resilient conducting element so as to partially shield said surface; the structure of the material from which said at least one resilient electric conducting element is formed comprising a supporting matrix formed from flexible, electrically-insulating material and particles of electrically-conductive material scattered in a random, substantially uniform manner inside cells in said matrix; said cells communicating at least partially with one another and being at least partially larger in size than the respective particles of electrically-conductive material housed inside the same, so that said at least one resilient electric conducting element is able to selectively assume, in response to a localized pressure exerted on a portion of said conductor, a first, unwarped shape in which said surface of at least one said resilient conducting element is kept spaced apart from at least one of the other conducting elements of the conductor by said spacer element, and a second, warped shape in which said surface of at least one said resilient conducting element contacts, through said spacer element, at least one of the other conducting elements of the conductor, so as to complete an electrical circuit with said first and second conductors.

2. An electric conductor as claimed in claim 1, characterised by the fact that the said particles consist of granules of electrically-conductive material.

3. An electric conductor as claimed in claim 1, characterised by the fact that the said spacer element is located between the adjacent surfaces of the said third conducting element and one of the said first and second conducting elements.

4. An electric conductor as claimed in claim 1, characterised by the fact that it comprises a pair of the said third electric conducting elements; the said spacer element being located between the adjacent surfaces of the said third elements.

5. An electric conductor as claimed in claim 1, characterised by the fact that each of the said first and second conducting elements defines a series of strips lying in the same plane; the said third conducting element being located over the said strips, and the said spacer element being located between the said strips and the said third element.

6. An electric conductor as claimed in claim 1, characterised by the fact that each of the said first and second electric conducting elements consists of a wire mesh.

7. An electric conductor as claimed in claim 1, characterised by the fact that the said spacer element consists of a mesh of insulating material.

* * * * *